United States Patent [19]

Linden et al.

[11] 4,000,606

[45] Jan. 4, 1977

[54] CHAIN MAKING APPARATUS

[75] Inventors: Sven-Erik Lindén, Laxa; Nils Gunnar Krister Forsberg, Ornskoldsvik, both of Sweden

[73] Assignee: Elektriska Svetsningsaktiebolaget, Gothenburg, Sweden

[22] Filed: Feb. 9, 1976

[21] Appl. No.: 656,628

[30] Foreign Application Priority Data

Feb. 10, 1975 Sweden ..... 7501415

[52] U.S. Cl. ..... 59/16; 59/22

[51] Int. Cl.[2] ..... B21L 7/00

[58] Field of Search ..... 59/25, 24, 23, 22, 18, 59/16, 26

[56] References Cited

UNITED STATES PATENTS

| | | | |
|---|---|---|---|
| 3,701,251 | 10/1972 | Andreasson et al. | 59/16 |
| 3,945,198 | 3/1976 | Linden et al. | 59/22 X |

FOREIGN PATENTS OR APPLICATIONS

| | | | |
|---|---|---|---|
| 1,206,703 | 12/1965 | Germany | 59/22 |

*Primary Examiner*—Milton S. Mehr

*Attorney, Agent, or Firm*—Lerner, David, Littenberg & Samuel

[57] ABSTRACT

A chain making plant for the manufacture of two chains at a time by means of a series of operating stations arranged along a substantially straight course. Two conveyor units are provided, each of which successively presents a depending portion of one chain to the operating stations. Each of the conveyor units comprises a carriage running on a track extending along the course and a transverse chain conveyor supported by said carriage. A stationary supporting structure is provided outside of the middle portion of each of the tracks, said structure including a chain wheel arranged at such height and such a transverse distance with respect to the discharge end of the transverse chain conveyor as to allow a sagging portion of the chain supported at one end by the discharge end of the transverse chain conveyor and at the other end by said chain wheel to turn freely about said chain wheel.

4 Claims, 5 Drawing Figures

CHAIN MAKING APPARATUS

BACKGROUND OF THE INVENTION

This invention relates to apparatus for making chains, particularly large chains made from bar stock having a diameter of 30 mm or more. More particularly, the invention relates to a plant for manufacturing two chains at a time comprising a pair of substantially parallel straight tracks arranged one at each side of a lane or course, a first carriage running on one of said tracks for moving a depending portion of one chain previously formed along said course to be presented successively to a plurality of operating stations provided in said course for performing a succession of operations including inserting a heated piece of bar into the lowest link of said depending portion and bending said piece of bar to form a link, flash butt welding the joint of said link and trimming the joint to remove the welding burr or budge, and a second carriage running on the other track for moving a depending end portion of the other chain along said course to be presented to said operating stations, and motor-driven conveyor means supported by each of said carriages for advancing the chain outwards in the transverse direction from said course, said conveyor means including a delivery member from which the chain is paid out.

In existing plant of this kind, the chain emerging from said delivery member hangs down on to the floor on which it forms a heap from which the chain is periodically pulled off towards a storing station or receptacle such as a large container or a lighter. The displacements of the carriage along its track cause all of or some of the chain links forming said heap to be dragged along the shop floor. The effort required for this dragging action considerably adds to the power demands on the carriage drive and to the stresses to which the carriage is subjected. The periodical outbreak of very loud rattling, bumping and clanging noises caused by the chain links tumbling on to each other and to the floor when the carriage is displaced is objectionable, the more so as the operation of the chain making plant is otherwise comparatively quiet. Also, heavy wear of the flooring is caused by the dragging of the heavy chain links along the floor. The disadvantages are particularly serious in the manufacture of very heavy chains such as now frequently required as mooring chains for large tankers, floating oil boring platforms etc. Such chains are made from 50 mm diameter or still heavier bar stock, and the weight of one link may amount to 500 kgs.

SUMMARY OF THE INVENTION

The invention provides, in a chain making plant of the type above specified, the improvement comprising, for each of the tracks, a stationary supporting structure arranged outside of the middle portion of the track, said structure including a chain supporting member arranged at such a height and such a transverse distance with respect to said delivery member as to allow a sagging portion of the chain supported at one end by said delivery member and at the other end by said chain supporting member to turn freely about said supporting member during displacement of the carriage along its track.

Preferably said chain supporting member consists of a chain wheel supported for rotation about a horizontal axis, motor-driven means being provided for rotating the wheel. In a preferred embodiment of the invention, the bearing means supporting said chain wheel are pivotably supported for rotation about a vertical axis so as to allow the chain wheel to be aligned to the changing direction of the sagging portion of the chain.

Other features and advantages of the invention will appear from the following description and from the accompanying drawings representing somewhat schematically two embodiments of the invention.

DESCRIPTION OF THE EMBODIMENTS

Figure 1:
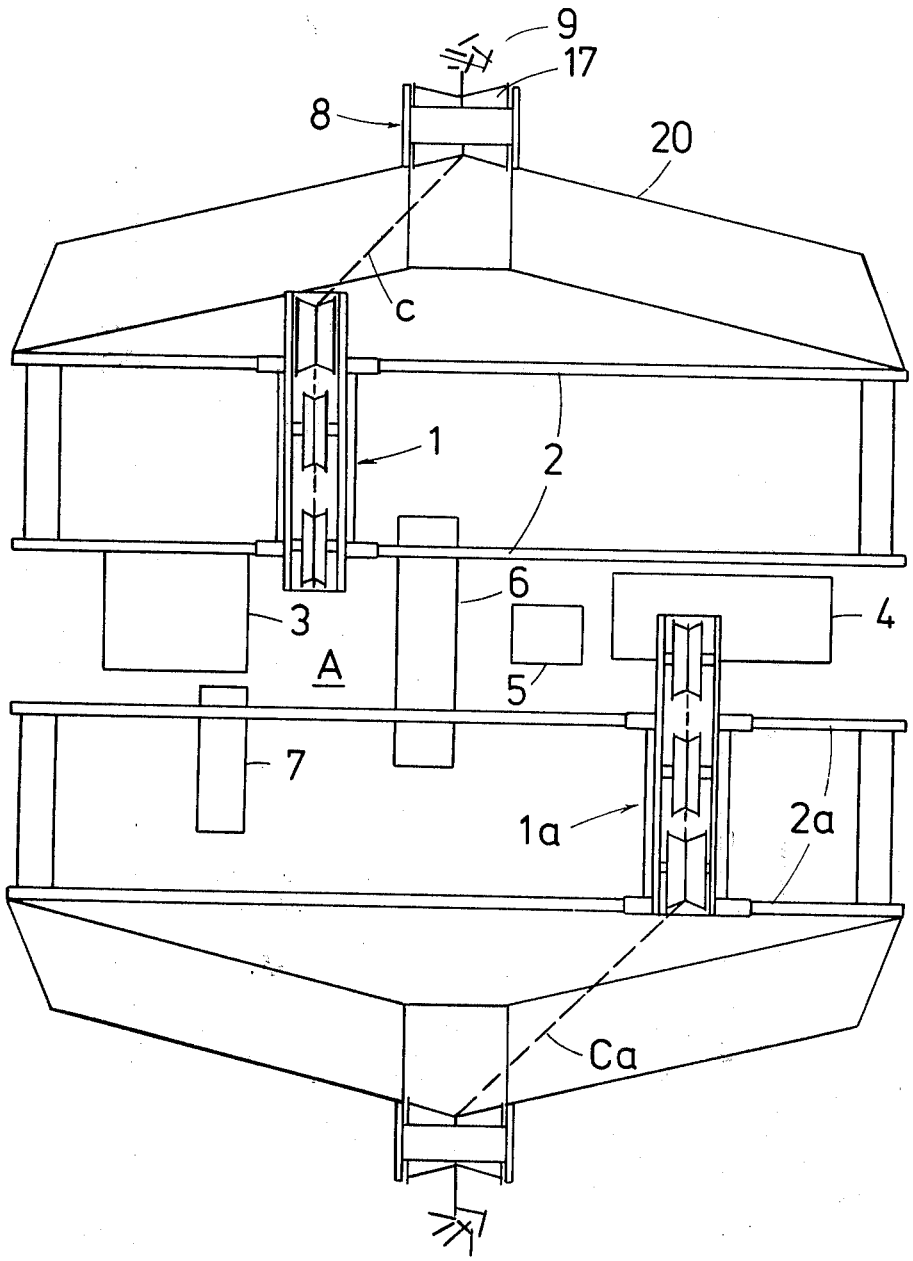
FIG. 1 is a plan view of a chain making plant including a first embodiment of the invention.

Referring first to FIG. 1, a group of operating machines 3 to 6 is arranged along a course or lane A on a shop floor. Said group includes a bending machine 3, a flash welding machine 4, a trimming machine 5 and a stud press 6. All of said machines are represented by their outlines only and do not have to be described, as such machines and their operation are familiar to those skilled in the chain making art. A piece of bar cut to the proper length to form a link is heated in a heater 7 placed beside the bending machine 3, inserted into the last link of a chain and bent to form a C-shaped link. Said link, along with the end of the chain to which it is attached, is then shifted to the welding machine 4, in which the flash welding of the joint is performed. The welding burr is removed in the trimming machine 5. Finally, the link is fitted with a stud in the stud press 6.

To utilize the capacity of the machine as well as possible, two chains C, C*a* at a time are manufactured in the plant. A pair of conveyor units 1, 1*a* serve to support the depending ends of the chains and to shift them as required between the operating machines. Each of the conveyor units 1, 1*a* comprises a carriage running on one of a pair of elevated straight tracks 2, 2*a*. Said tracks, each of which consists of a pair of rails, extend parallelly to each other at either side of the course or lane A. As the conveyor units 1, 1*a* are of identical design, one conveyor unit 1 only and the embodiment of the invention arranged to cooperate with it are represented in more detail in FIGS. 2 and 3, to which reference is now made.

The conveyor unit 1 comprises a carriage or trolley 10 running on the two-rail track 2 and a transverse conveyor frame 11 provided with guide rails 12 supported on rolls 13 in the carriage 10 for transverse displacement with respect to the carriage, at least one of said rolls being provided with a suitable power drive (not shown) for adjusting the transverse position of the frame 11. Three chain wheels 15*a*, 15*b*, 15*c* rotatably mounted in the frame 11 are arranged to be driven by a common motor 16 through suitable drive transmissions. The inner end of the chain to be fitted successively with additional links depends freely from the innermost chain wheel 15*a* through a drum 14. Said drum is rotatable about its vertical axis and provided at its lower extremity with a cruciform guide slot by means of which the lower end of the depending chain portion can be rotated through 90° to put the bottom link in the proper position with respect to the operating machine. The transverse position of said link is adjusted by means of the motor-driven roll 12, and its vertical position is adjusted by means of the chain rolls 15*a*, 15*b*, 15*c*.

An additional chain wheel 17 which can be rotated by means of a power drive 18 is supported by a stand 8 arranged outside of the middle portion of the track 2. The vertical position of the chain wheel 17 with respect to the chain wheel 15*c* and the transversal width of the space separating said chain wheels are adequate to allow the sagging portion of the chain C supported between the chain wheels 15*c* and 17 to turn freely about the wheel 17 during the displacements of the carriage 10 along the track 2. The wheel 17 has a width sufficient to provide adequate engagement between the wheel and the chain also when the conveyor unit 1 has a position at either of the ends of the track 2. On leaving the chain wheel 17, the chain may be allowed to form a heap, as indicated at 9, on the floor or in a suitable receptacle. Long chains are preferably caused to pass on directly from the chain wheel 17 to a conveyor for the successive transport of the chain to a more or less distant receptacle or collecting site. Apparatus may be provided for subjecting the chain to various additional operations during its passage through said conveyor, for instance a tensile strength testing machine and a surfacing station, in which the chain links are given a coating of asphalt.

A roof 20 is provided in the space between the stand 8 and the carriage track 2 to protect the operators from the heat radiation of the sagging portion of the chain C and also from particles of hot shale etc. dropping from the chain.

The slack of the chain between the chain wheels 15*c* and 17 is adjusted by means of the drive 18 of the latter wheel. The slack must not be too small, as this would subject the wheels 15*c* and 17 and the means supporting them to undesirably large stresses from the suspended portion of the chain. Neither should the slack be so large as to cause the chain to encounter the roof 20.

Figure 2:
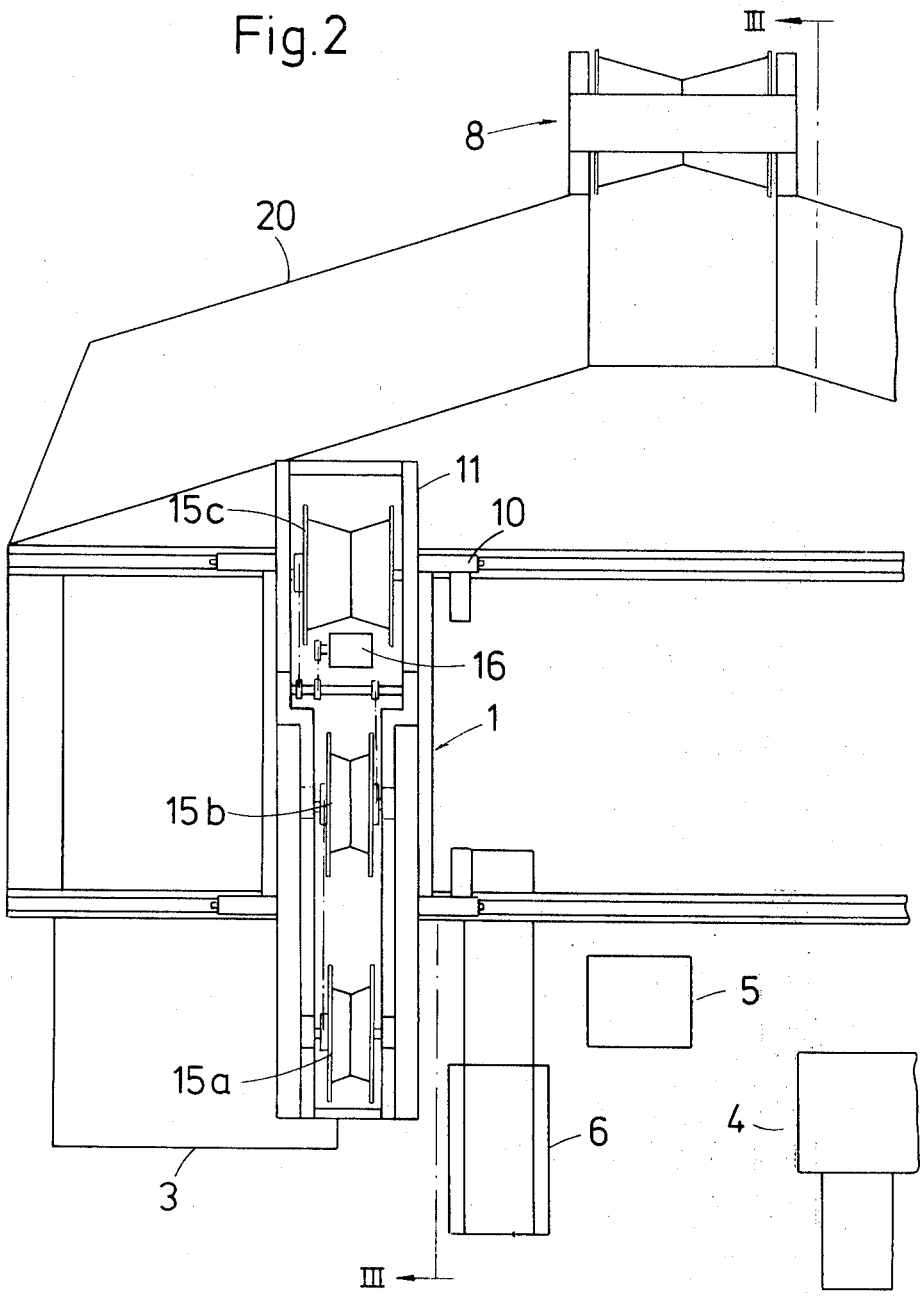
FIG. 2 is a plan view on a larger scale than FIG. 1 of part of the plant of FIG. 3.
Figure 3:
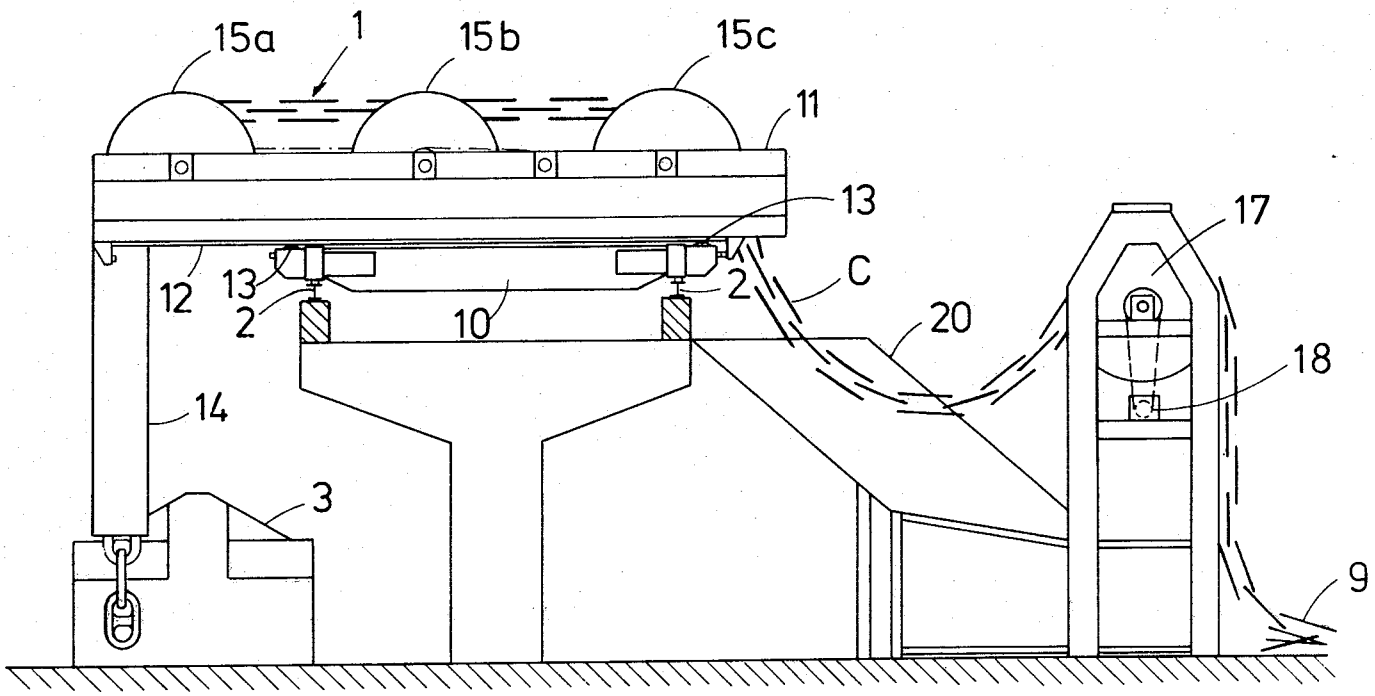
FIG. 3 is a sectional view taken at III—III in FIG. 2.
Figure 4:
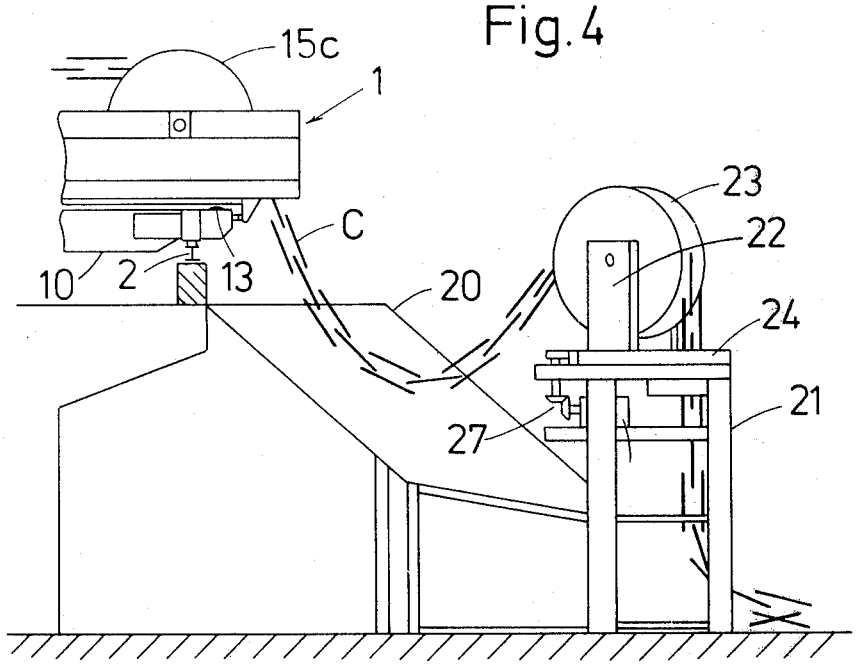
FIGS. 4 and 5 are, respectively, a side view and a plan view of part of a chain making plant similar to the one of FIGS. 1 to 3 but equipped with a preferred embodiment of the invention.
Figure 5:
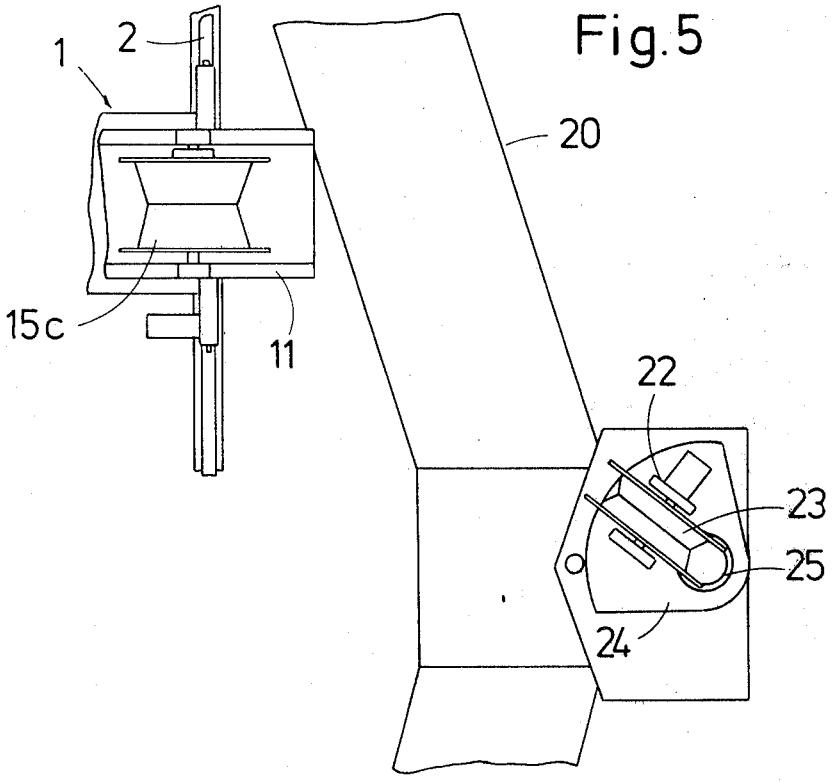

In the embodiment of the invention illustrated in FIGS. 4 and 5, a chain wheel 23 performing the same function as the chain wheel 17 of FIGS. 1 to 3 is rotatably supported in a bearing unit consisting of a gear wheel sector 24 and a pair of uprights 22 rigidly connected to said gear wheel sector. The gear wheel sector 24 is supported by the stand 21 for angular displacement about a pivot 25 the axis of which extends in the plane of rotation of the wheel 23. The gear wheel sector 24 is rotated by a pinion 26 operated by a motor 26 through suitable transmission gear 27. The angular displacement of the gear wheel sector 24 and the wheel 23 supported thereby is coordinated, preferably through automatic control means, with the displacement of the conveyor unit 1 along the track 2 in such a way as to maintain the central plane of rotation of the chain wheel 23 aligned with the direction from said wheel to the chain wheel 15*c* of the conveyor unit 1. As in this case the chain always encounters the chain wheel 23 straight on, the width of the chain wheel need not substantially exceed the width of the largest chain links to be manufactured in the plant.

We claim:

1. In a plant for the manufacture of two chains at a time comprising a pair of substantially parallel straight tracks at either side of a course, a first carriage running on one of said tracks for moving a depending end portion of one chain previously formed along said course to be presented successively to a plurality of operating stations provided in said course for performing a succession of operations including inserting a heated piece of bar into the lowest link of said depending portion and bending said piece of bar to form a link, flash butt welding the joint of said link and trimming the joint to remove the welding burr or bulge, and a second carriage running on the other track for moving a depending end portion of the other chain along said course to be presented to said operating stations, and motor-driven conveyor means supported by each of said carriages for advancing the chain outwards in the transverse direction from said course, said conveyor means including a delivery member from which the chain is paid out, the improvement comprising, for each of the tracks, a stationary supporting structure arranged outside of the middle portion of the track, said structure including a chain supporting member arranged at such a height and such a transverse distance with respect to said delivery member as to allow a sagging portion of the chain supported at one end by said delivery member and at the other end by said chain supporting member to turn freely about said supporting member during displacement of the carriage along its track.

2. A chain-making plant as claimed in claim 1 in which said chain supporting member is a chain wheel supported for rotation about a horizontal axis.

3. A chain making plant as claimed in claim 2 comprising motor-driven means for rotating said chain wheel about said horizontal axis.

4. A chain making plant as claimed in claim 2 comprising a bearing unit for said chain wheel, and bearing means for supporting said bearing unit for rotation about a vertical pivot axis extending in the central plane of rotation of said chain wheel.

* * * * *